United States Patent [19]

Hatch

[11] Patent Number: 4,960,050

[45] Date of Patent: Oct. 2, 1990

[54] LIQUID TRANSFER ARTICLE HAVING A VAPOR DEPOSITED PROTECTIVE PARYLENE FILM

[75] Inventor: Russell B. Hatch, Swindon, England

[73] Assignee: Union Carbide Coatings Service Technology Corp., Danbury, Conn.

[21] Appl. No.: 376,524

[22] Filed: Jul. 7, 1989

[51] Int. Cl.[5] ..... B41F 31/26

[52] U.S. Cl. ..... 101/348; 29/121.1; 29/132; 29/148.4 D; 427/255.6

[58] Field of Search ..... 101/348, 349, 350; 29/148.4 D, 121.1, 132; 427/255.6

[56] References Cited

U.S. PATENT DOCUMENTS 4,173,664 11/1979 Cieloszyk ..... 427/255.6 X
4,566,938 1/1986 Jenkins et al. ..... 156/643
4,567,827 2/1986 Fadner ..... 101/350
4,601,242 7/1986 Fadner ..... 101/348

FOREIGN PATENT DOCUMENTS 3713027 11/1988 Fed. Rep. of Germany .
2049102 12/1980 United Kingdom .

*Primary Examiner*—Clifford D. Crowder
*Attorney, Agent, or Firm*—Cornelius F. O'Brien

[57] ABSTRACT

A liquid transfer article, such as an ink roll, and method for producing it, in which the article comprises a substrate coated with a ceramic or metallic carbide coating having engraved in its surface a pattern of wells adapted for receiving a metered quantity of a liquid, such as ink, and wherein the microporosities in the surface of the wells are filled with a film of a vapor-deposited polymer, such as parylene.

9 Claims, 3 Drawing Sheets

LIQUID TRANSFER ARTICLE HAVING A VAPOR DEPOSITED PROTECTIVE PARYLENE FILM

FIELD OF THE INVENTION

The invention relates to a liquid transfer article for use in transferring a metered quantity of a liquid to another surface, said liquid transfer article comprising a substrate coated with ceramic or metallic carbide coatings having engraved in said coatings a pattern of wells adapted for receiving the metered quantity of liquid and wherein the microporosities in the surface of the wells are filled with a film of a vapor-deposited polymer.

BACKGROUND OF THE INVENTION

A liquid transfer article, such as a roll, is used in the printing industry to transfer a specified amount of a liquid, such as ink or other substances, from the liquid transfer article to another surface. The liquid transfer article generally comprises a surface with a pattern of depressions or wells adapted for receiving a liquid and in which said pattern is transferred to another surface when contacted by the liquid transfer article. When the liquid is ink and the ink is applied to the article, the wells are filled with the ink while the remaining surface of the article is wiped off. Since the ink is contained only in the pattern defined by the wells, it is this pattern that is transferred to another surface.

In commercial practice, a wiper or doctor blade is used to remove any excess liquid from the surface of the liquid transfer article. If the surface of the coated article is too coarse, excessive liquid, such as ink, will not be removed from the land area surface of the coarse article thereby resulting in the transfer of too much ink onto the receiving surface and/or onto the wrong place. Therefore, the surface of the liquid transfer article should be finished and the wells or depressions clearly defined so that they can accept the liquid.

A gravure-type roll is commonly used as a liquid transfer roll. A gravure-type roll is also referred to as an applicator or pattern roll. A gravure roll is produced by cutting or engraving various sizes of wells into portions of the roll surface. These wells are filled with liquid and then the liquid is transferred to the receiving surface. The diameter and depth of the wells may be varied to control the volume of liquid transfer. It is the location of the wells that provides a pattern of the liquid to be transferred to the receiving surface while the land area defining the wells does not contain any liquid and therefore cannot transfer any liquid. The land area is at a common surface level, such that when liquid is applied to the surface and the liquid fills or floods the wells, excess liquid can be removed from the land area by wiping across the roll surface with a doctor blade.

The depth and size of each well determines the amount of liquid which is transferred to the receiving surface. By controlling the depth and size of the wells, and the location of the wells (pattern) on the surface, a precise control of the volume of liquid to be transferred and the location of the liquid to be transferred to a receiving surface can be achieved. In addition, the liquid may be transferred to a receiving surface in a predetermined pattern to a high degree of precision having different print densities by having various depth and/or size of wells.

Typically, a gravure roll is a metal roll with an outer layer of copper. Generally, the engraving techniques employed to engrave the copper are mechanical processes, e.g., using a diamond stylus to dig the well pattern, or photochemical processes that chemically etch the well pattern.

After completion of the engraving, the copper surface is usually plated with chrome. This last step is required to improve the wear life of the engraved copper surface of the roll. Without the chrome plating, the roll wears quickly, and is more easily corroded by the inks used in the printing. For this reason, without the chrome plating, the copper roll has an unacceptably low life.

However, even with chrome plating, the life of the roll is often unacceptably short. This is due to the abrasive nature of the fluids and the scrapping action caused by the doctor blade. In many applications, the rapid wear of the roll is compensated by providing an oversized roll with wells having oversized depths. However, this roll has the disadvantage of higher liquid transfer when the roll is new. In addition, as the roll wears, the volume of liquid transferred to a receiving surface rapidly decreases thereby causing quality control problems. The rapid wear of the chromeplated copper roll also results in considerable downtime and maintenance costs.

Ceramic coatings have been used for many years on anilox rolls to give extremely long life. Anilox rolls are liquid transfer rolls which transfer a uniform liquid volume over the entire working surface of the rolls. Engraving of ceramic coated rolls cannot be done with conventional engraving methods used for engraving copper rolls; so these rolls must be engraved with a high energy beam, such as a laser or an electron beam. Laser engraving results in the formation of wells with a new recast surface about each well and above the original surface of the roll, such recast surface having an appearance of a miniature volcano crater about each well. This is caused by solidification of the molten material thrown from the surface when struck by the high energy beam. Thus the recast surface should be removed for most printing applications.

In offset printing the printing plate is not directly applied to the paper but first transfers its image to an offset blanket cylinder which is a flexographic surface, such as rubber, and the image is transferred from the blanket cylinder to the paper. Printing ink is applied to the plate cylinder by ink transfer or ink metering rolls which may be a single roll or may be a series of rolls. In lithography, the image and non-image areas are on the same plane on the printing plate but the image area is grease receptive and water-repellent whereas the non-image area is water-receptive and grease-repellent. The ink solvent therefore adheres only to the image areas, from which it is transferred to the surface to be printed, usually by the offset method.

In the printing cycle of lithography, water or "fountain solution" is fed to the printing plate roll just before it contacts the ink transfer rolls. This is usually done by means of rollers which meter the amount of water applied. The moisture film produced on the printing plate roll is continuous on the non-image areas of the plate and acts as a barrier preventing adhesion of ink. Any moisture on the greasy image areas is discontinuous and does not prevent transfer of ink to them.

For lithographic ink, careful selection of ingredients is essential. Since the ink comes into intimate and continuous contact with water during printing, it must be free from any tendency to bleed or to form an ink-inwater emulsion. The formation of water-in-ink emulsion is unavoidable, but this does no harm unless the working consistency of the ink is damaged. During normal printing, the ink takes up from 5% to 30% of water as a water-in-ink emulsion. There is, however, still very little known about the surface chemistry of this ink/water relationship.

The ink transfer or metering roll surface must be oleophilic so that it receives the greasy printing ink into the wells engraved on its surface and must also be hydrophobic so that it repels water which is on the surface of the printing roll. Traditionally, an ink transfer roll has been made with a pore-free surface of copper which has been found to be both oleophilic and hydrophobic. In practice and as stated above, copper surfaces are relatively soft and are not hard wearing, and therefore the surface of the engraved copper roll generally has been coated with a layer of pore-free chromium to increase its resistance to wear. Such wear is particularly evident where doctor blades are used to meter the amount of ink transferred. The application of a doctor blade however does produce continuous wear on the surface of the transfer roll and much consideration has been given in the past to the production of ink transfer or ink metering rolls which are much more resistant to wear.

First an attempt was made to coat the copper with a microporous layer of ceramic. It presumably was thought that the microporous ceramic would retain the oleophilic and hydrophobic properties of the pore-free copper surface while improving its wear-resistant properties. In practice this was found not to work and satisfactory transfer of ink evenly over the printing areas of the plotting plate was not achieved in practice.

Another attempt to solve the problem of wear was to coat the base roll with a ceramic and engrave the surface of the ceramic. Of these base rolls, those coated with a chromium oxide layer and engraved with a pattern of wells by a pulsed laser beam technique did solve the problem of wear. However, another problem was found to arise in the case of such ceramic coated rolls in that after a while it was found that the transfer of ink became patchy. The reason was found to be that some of the wells in the ink well pattern engraved on the ceramic surface changed their properties from oleophilic to oleophobic thus reducing the amount of ink transferred over areas of the transfer roll where this occurred thereby forming an uneven application of ink to the printing roll.

To avoid this, such rolls have been coated with a thin pore free layer of copper which, of course, is known to have the surface properties needed for ink transfer over long periods without this disadvantage occurring.

German Patent Application DE No. 3713027A1 discloses a liquid transfer roll having a multiplicity of wells and wherein the wells contain a moisture-repellant coating of a material such as vapor-deposited copper, nickel, silicon, asphalt or a suitable synthetic in the form of Teflon which is a trademark of E. I. DuPont de Nemours & Co. for polytetrafluoroethylene or Mylar which is a trademark of E. I. DuPont de Nemours & Co. for polyester film made from polyethylene terephthalate resin.

It has now been found that very thin films of certain vapor-deposited polymers when applied to the surface of the wells in a ceramic coated liquid transfer roll will fill any microporosities in the surface caused by the laser engraving and prevent the change in surface characteristics of the wells from oleophilic to oleophobic and from hydrophobic to hydrophilic.

In its broadest aspect therefore, the present invention provides a liquid transfer article, such as an ink transfer roll for use in offset printing, which comprises a base roll coated with a ceramic layer and having engraved in said ceramic layer a pattern of liquid receiving wells, characterized in that the microporosities in the surface of each of said wells is filled with a film of a vapor-deposited polymer.

The invention also provides a method of forming a liquid transfer article for use in offset printing comprising coating a base substrate with a layer of ceramic or metallic carbide and engraving a pattern of liquid receiving wells on the surface of the coating by means of a laser beam and then vapor depositing a polymer to fill any microporosities in the surface of the wells.

It is an object of the present invention to provide a thin film of a vapor-deposited polymer on the surface of wells engraved in a liquid transfer article.

It is another object of this invention to provide a liquid transfer article having a pattern of engraved wells in which any microporosities in the surface of the wells are filled with a vapor-deposited polymer.

It is another object of the present invention to provide a liquid transfer roll for use in the printing industry with a ceramic coating having a pattern of engraved wells coated with a thin film of parylene which effectively fills any microporosity in the surface of the wells.

It is another object of the present invention to provide a method for forming a liquid transfer article having a pattern of engraved wells with a vapor-deposited polymer filling any microposorities in the surface of the wells and coating the surface of the wells with a thin layer of the polymer that exhibits oleophilic and hydrophobic characteristics.

The above and further objects and advantages will become apparent upon consideration of the following description thereof.

SUMMARY OF THE INVENTION

The invention relates to a liquid transfer article for use in transferring a metered quantity of a liquid to another surface comprising a substrate coated with a ceramic or metallic carbide coating; a pattern of wells engraved in said coating with each of said wells adapted for receiving a metered quantity of a liquid; and wherein the microporosities in the surface of the wells are filled with a vapor-deposited polymer. The vapor-deposited polymer also provides a thin film coating of the surface of the wells that exhibit oleophilic and hydrophobic characteristics.

The invention also relates to a method for producing a liquid transfer article for use in transferring a metered quantity of a liquid to another surface comprising the steps:

(a) coating a liquid transfer article with at least one layer of a coating material selected from the group consisting of ceramic and metallic carbides;
(b) engraving the surface of the coated liquid transfer article to produce in said surface a pattern of wells adapted for receiving liquid; and
(c) vapor depositing a polymer on the surface of said wells to fill any microporosities in the surface of said wells.

The preferred polymer for use in this invention is parylene because it has the ability to provide ultra-thin films that can conform to substrates of varied geometrical shapes. This will enable the parylene to enter into not only the extremely small wells, but also fill any microporosities, e.g., cracks, fissures, pinholes or crevices, that generally form in the surface of the wells during the laser engraving process. Although the wells can be as small as 10 microns diameter and 2 microns height, the parylene can still fill any microporosities that may have been formed in the surface of the wells due to the laser engraving process. Vapor-deposited parylene provides a tough pinhole free film that can be deposited as thin as 0.10 micron and up to 100 microns. Parylene is a physically stable and chemically inert poly-crystalline material that is extremely resistant to chemical attack and insoluble in most known solvents. It provides excellent protection from moisture, corrosive vapors and other hostile environments. Vapor-deposited parylene also provides pinhole free coverage, microporosity penetration and purity in conformal coatings.

Parylene is a generic term applied to the family of unsubstituted and substituted poly-p-xylylenes. The polymers can be homopolymers or copolymers depending on whether they are derived from one particular dimer or a mixture of different dimers. The unsubstituted homopolymer poly-p-xylylene has the structure:

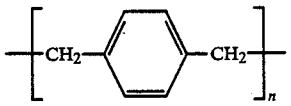

and substituted homopolymers may be illustrated by the following structures:

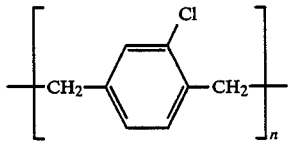

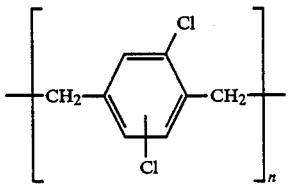

The substituent can be any organic or inorganic group, which can normally be substituted on aromatic nuclei provided that the dimer and monomer are vaporizable under process conditions. Examples of substituents are the halogens, and cyano groups, e.g., cyanoparylene and dicyanoparylene. Fluorine atoms or other substituents can be substituted for the hydrogen atoms in the methylene groups, if desired.

A description of parylene, processes for making it, and the apparatus in which parylene deposition can be effected may be found in U.S. Pat. Nos. 3,246,627; 3,301,707; and 3,600,216, all of which patents are incorporated herein by reference as if they were printed in their entirety. It will be observed, however, that the term "parylene" is not used in these patents. Instead, the term poly-p-xylylene is used generically and this term is considered to include both the unsubstituted and substituted varieties in the form of homopolymers or copolymers just as the term parylene does in this specification.

The process for coating a substrate with parylene is conventional. Typical steps and conditions of such a process involve first vaporizing a cyclic dimer which contains the desired repeating unit, e.g., cyclic di-p-xylylene, at a pressure of about 0.1 to about 1 Torr and at a temperature of about 150° C. to about 200° C.; then, pryolyzing the vaporized cyclic dimer at slightly lower pressure at about 670° C. to about 690° C., the pyrolysis step breaking the benzylic carbon to carbon bonds to provide the p-xylylene monomer in the vapor state; and, finally, introducing the vaporous monomer into a deposition chamber containing the substrate, at still slightly lower pressure, but at ambient temperatures in the range of about 20° C. to about 30° C., whereby the monomer condenses and polymerizes on all of the exposed surface of the substrate to provide a thin parylene film. There is a slight pressure gradient established throughout the process, the pressure progressively getting lower in each stage. This pressure differential drives the vapor from one stage of the process to the next.

The apparatus used typically comprises a vaporized or sublimator section, a pyrolysis zone, and a deposition chamber, all connected by tubing, with the deposition chamber having a valved outlet connected to a pump for providing the required pressure. Heating means for vaporization and pyrolysis are provided while condensation is effected by ambient temperature.

The thickness of the parylene film can be from 0.1 to 100 microns. For most applications of this invention, the thickness of the parylene film should be from 0.5 to 10 microns. Deposits of parylene less than 0.5 micron thick would not generally provide adequate protection for the surface of the wells to insure that the microporosities in the surface of the wells are filled and that the overall surface remains oleophilic and hydrophobic while a coating more than 10 microns thick could in some applications needlessly reduce the capacity of the wells for holding the liquid.

In the case of ink transfer rolls the depth of the wells engraved in the surface of the ceramic is not usually more than about 20 microns and the thickness of the film of the vapor-deposited polymers should be as thin as possible, consistent with retention of the oleophilic and hydrophobic properties of the wells and filling the microporosities in the wells. In practice, it has been found that coatings from about 0.5 micron to about 5 microns, preferably from about 1 micron to about 3 microns, in thickness are effective to achieve these purposes. Most preferably, a coating of about 1.5 micron would be suitable for most applications.

Without being bound by theory, it is now believed that the change in surface properties of the wells arises out of the absorption of water into the microporosities (fissures, cavities and pinholes) in the wells surface produced during the engraving process, such water being preferentially absorbed into the microporosities. Any absorbed water ultimately builds up to a point where it retards or prevents ink take up by the wells, i.e., it changes the surface properties of the individual wells and causes what is termed "blinding" on the surface of the ink transfer roll. It is believed that the vapor-deposited polymer coating fills the microporosities in the wells' surface and prevents the absorption of water into such microporosities.

The general process steps necessary in producing an ink roll according to the method of the present invention involve first grit blasting the surface of the metallic substrate roll usually of low carbon steel or copper, etc. and applying to the grit blasted surface a coating such as ceramic by thermally spraying the coating onto the surface. The coating is next ground so as to remove surface irregularities from the coating surface and is then engraved with a suitable pattern by a pulsed laser technique. Since the engraving process throws up a certain amount of recast at the edges of the wells produced by the laser beam pulses, the roll could be polished after engraving so as to provide a smooth surface which in some applications will involve contact with a doctor blade. The application of the vapor-deposited polymer can be carried out either before or after the final polishing, but is preferably carried out after the final polishing. Since the amount of polymer which is applied is very thin, it does not deleteriously affect the final surface which takes the doctor blade.

Any suitable coating such as a refractory oxide or metallic carbide coating, may be applied to the surface of the roll. For example, tungsten carbide-cobalt, tungsten carbide-nickel, tungsten carbide-cobalt chromium, tungsten carbide-nickel chromium, chromium-nickel, aluminum oxide, chromium carbide-nickel chromium, chromium carbide-cobalt chromium, tungsten-titanium carbide-nickel, cobalt alloys, oxide dispersion in cobalt alloys, aluminum-titania, copper based alloys, chromium based alloys, chromium oxide, chromium oxide plus aluminum oxide, titanium oxide, titanium plus aluminum oxide, iron based alloys, oxide dispersed in iron based alloys, nickel and nickel based alloys, and the like may be used. Preferably chromium oxide ($Cr_2O_3$), aluminum oxide ($Al_2O_3$), silicon oxide ($SiO_2$) or mixtures thereof could be used as the coating material, with chromium oxide being the most preferred.

The ceramic or metallic carbide coatings can be applied to the metal surface of the roll by either of two well known techniques; namely, the detonation gun (D-gun) process or the plasma coating process. The detonation gun process is well known and fully described in U.S. Pat. Nos. 2,714,563; 4,173,685; and 4,519,840, the disclosures of which are hereby incorporated by reference as if they were printed in their entirety. Conventional plasma techniques for coating a substrate are described in U.S. Pat. Nos. 3,016,447; 3,914,573; 3,958,097; 4,173,685; and 4,519,840, the disclosures of which are hereby incorporated by reference as if they were printed in their entirety. The thickness of the coating applied by either the plasma process or D-gun process can range from 0.5 to 100 mils and the roughness ranges from about 50 to about 1000 micro-inches $R_a$ depending on the process, i.e. D-gun or plasma, the type of coating material, and the thickness of the coating. As used herein, $R_a$ is the average surface roughness measured in micro-inches by ANSI Method B46.1, 1978. In this measuring system, the higher the number, the rougher the surface.

A wide variety of laser machines are available for forming wells in the ceramic or metallic carbide coatings. In general, lasers capable of producing a beam or pulse of radiation of from 0.0001 to 0.4 joule per laser pulse for a duration of 10 to 300 microseconds can be used. The laser pulses can be separated by 30 to 2000 microseconds depending on the specific pattern of well desired. Higher or lower values of the energy and time periods can be employed and other laser-engraved techniques readily available in the art can be used for this invention. After laser-engraving, the roughness should typically range from 20 to 1000 micro-inches $R_a$ and the wells can range from 10 microns to 300 microns diameter and from 2 microns to 250 microns height.

The liquid that can be transferred to a receiving surface is any liquid such as ink, liquid adhesives and the like.

The invention will be further illustrated by reference to the accompanying drawings in which.

Figure 1:
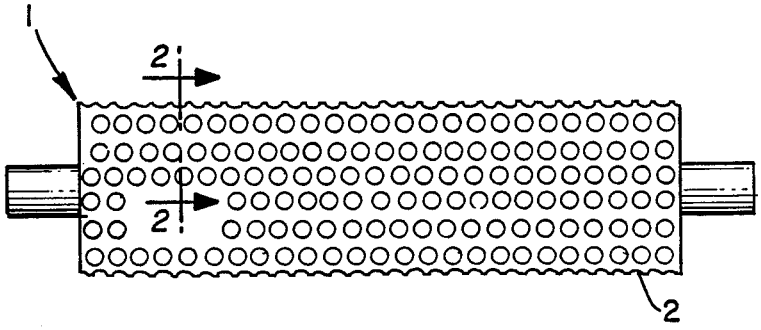
FIG. 1 is a perspective view of an ink transfer roll.
Figure 2:
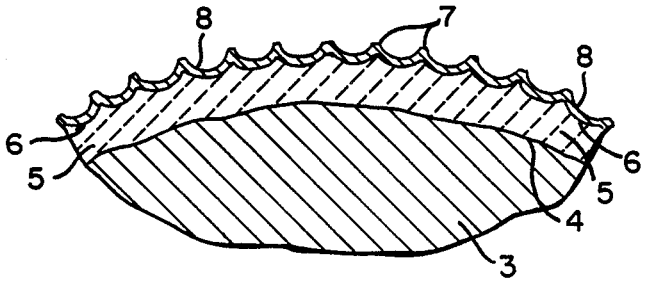
FIG. 2 is a cross section through the lines A—A of FIG. 1.

Referring to the drawings, an ink transfer roll generally designated as 1, comprises a cylinder 2 composed of a substrate 3 of low carbon steel, the surface of which has been grit blasted to provide a roughened surface 4. A ceramic coating 5 (preferably chromium oxide) 75 to 100 microns thick overlays the grit blasted surface 4 having been applied thereto by thermal spraying The surface of the ceramic layer 5 is formed by grinding, laser beam engraving and polishing into a pattern of wells 6 for receiving ink, the surface areas 7 between the wells being polished to take a doctor blade (not shown). The surface of the wells 6 and polished surface areas 7 is coated with a film of parylene, preferably about 1.5 micron thick.

The coated layer 5 can be applied by conventional techniques followed by conventional grinding to provide a surface of less than 0.5 micro meter $R_a$.

The polished engraved surface of this invention can then be coated with a film of parylene by conventional vapor-deposition techniques referred to above. The surface to be coated with parylene can be degreased at 48° C. using a chlorinated solvent and ultrasonic vibration, the degreasing being carried out in three steps using fresh chlorinated solvent at each step. The surface is then soaked in an isopropanol/deionized water mixture and then dipped into a promotion system composed of UCAR-A174 (UCAR is a Registered Trademark of Union Carbide) in an isopropanol/deionized water mixture. The dipped surface is then dried in an oven at 75° C. with air circulation followed by vacuum drying at 75° C. The parylene can then be vapor-deposited by conventional means to produce a film 1.5 micron thick. The vapor-deposited parylene will effectively fill any microporosities on the surface of the wells of the laser engraved roll while also depositing a thin film of parylene on the surface of the wells. The ink transfer roll is then ready for use in an offset printing apparatus.

Figure 3:
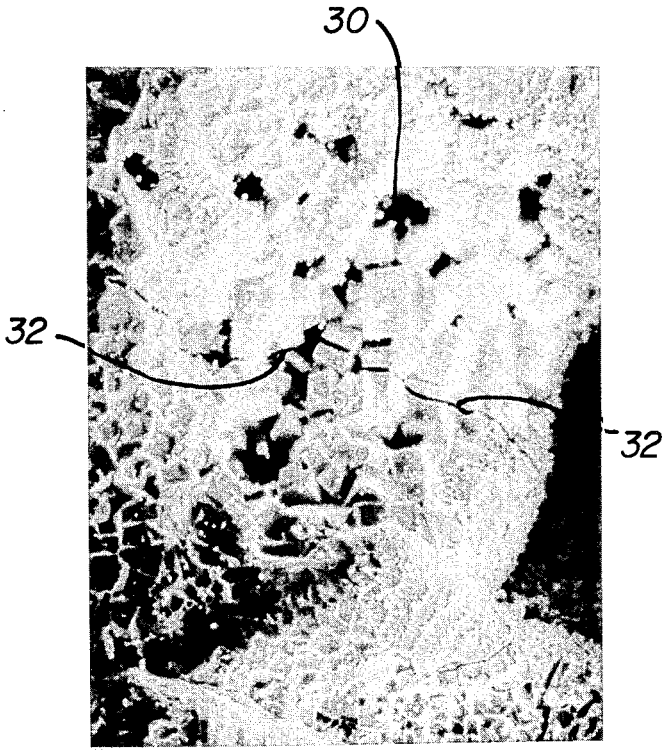
FIG. 3 is an enlarged photograph of the surface of a well in a laser engraved roll in accordance with the invention.
Figure 4:
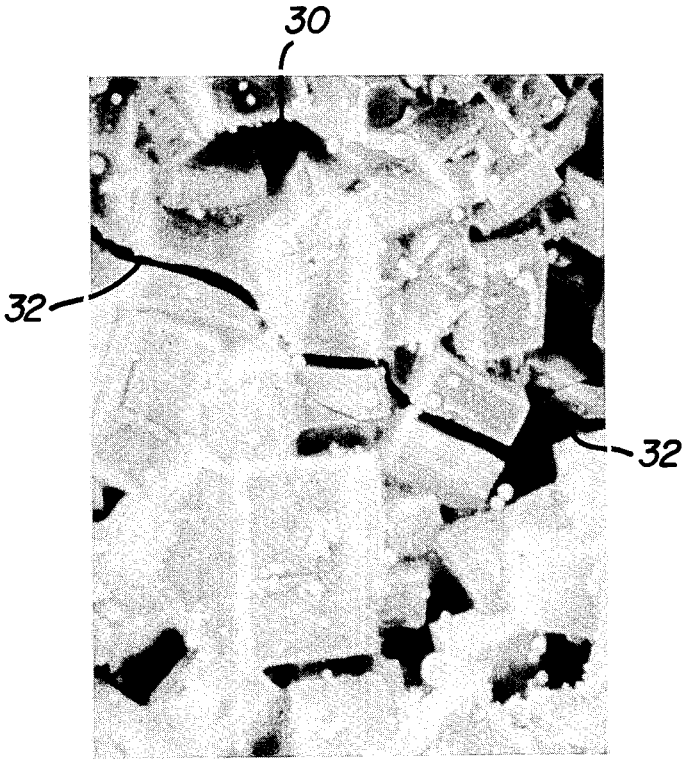
FIG. 4 is an enlarged photograph of the center area of the surface shown in the photograph in FIG. 3.

FIG. 3 shows an enlarged photograph of the surface of a well of a laser engraved roll while FIG. 4 shows an even larger photograph of the central area of the surface of the well shown in FIG. 3. As apparent from FIGS. 3 and 4, microporosities such as cavities 30 and cracks 32 are formed in the surface of the wells during the laser engraving process. In fact some of the crystals of the ceramic coating are cracked producing crevices and fissures in the surface of the wells. The vapor-deposited parylene will fill these microporosities and deposit an extremely thin uniform film on the surface of the wells that will prevent the absorption of water into such microporosities. In addition, the thin film of parylene exhibits oleophilic and hydrophobic characteristics which makes it ideally suited for liquid transfer applications.

As many possible embodiments may be made by this invention without departing from the scope thereof, it being understood that all matter set forth is to be interpreted as illustrative and not in a limiting sense. For example, this invention could be used to produce liquid transfer articles that could be used to impart patterns of liquid or adhesives to paper, cloth, films, wood, steel and the like.

What is claimed is:

1. A liquid transfer article for use in transferring a metered quantity of a liquid to another surface comprising a substrate coated with a material selected from the group consisting of ceramics, and metallic carbides; a pattern of wells engraved in said coating with each of said wells having a surface adapted for receiving a metered quantity of a liquid; and wherein any microporosities in the surface of the wells are filled with vapor-deposited parylene and wherein the surface of the wells has a vapor-deposited film of parylene from 0.1 to 3 microns thick.

2. The liquid transfer article of claim 1 wherein the wells are from 10 to 300 microns diameter and from 2 to 250 microns deep.

3. The liquid transfer article of claim 1 wherein the coated material on the substrate is selected from the group consisting of chromium oxide, aluminum oxide, silicon oxide and mixtures thereof.

4. The liquid transfer article of claim 3 wherein the coating material is chromium oxide.

5. The liquid transfer article of claim 1 wherein the vapor-deposited film of parylene is from 0.1 to 1 micron thick.

6. The liquid transfer article of claim 1 wherein said article is an ink roll.

7. A method for producing a liquid transfer article for use in transferring a metered quantity of a liquid to another surface comprising the steps:

(a) coating a liquid transfer article with at least one layer of a coating material selected from the group consisting of ceramics, and metallic carbides;

(b) engraving the surface of the coated material of the liquid transfer article to produce in the surface of said coated material a pattern of wells having a surface adapted for receiving liquid; and (c) vapor-depositing parylene on the surface of said wells to fill any microporosities in said surface of the wells and to deposit a film of said parylene from 0.1 to 3 microns thick on the surface of said wells.

8. The method of claim 7 wherein in step (a) the liquid transfer article is coated with a layer of a material selected from the group consisting of chromium oxide, aluminum oxide, silicon oxide and mixtures thereof.

9. The method of claim 7 wherein the liquid transfer article is an ink roll; the coating in step (a) is chromium oxide; and the film is vapor-deposited on the surface of the wells in step (c) to a thickness from 0.1 to 1.5 microns.

* * * * *